United States Patent [19]

Drefahl et al.

[11] 4,332,294

[45] Jun. 1, 1982

[54] GAS COOLER WITH MULTIPLY DEFORMED LEAD TUBES

[75] Inventors: Klaus Drefahl, Hanau; Helmut Gilles, Frankfurt am Main, both of Fed. Rep. of Germany

[73] Assignee: Metallgesellschaft Aktiengesellschaft, Frankfurt am Main, Fed. Rep. of Germany

[21] Appl. No.: 26,893

[22] Filed: Apr. 4, 1979

[30] Foreign Application Priority Data

Apr. 6, 1978 [DE] Fed. Rep. of Germany ..... 2814828

[51] Int. Cl.[3] ..... F28F 1/06

[52] U.S. Cl. ..... 165/157; 165/177; 138/38; 138/173

[58] Field of Search ..... 165/177, 157, 159, 179; 138/38, 173

[56] References Cited

U.S. PATENT DOCUMENTS

| | | | |
|---|---|---|---|
| 514,338 | 2/1894 | Row | 165/177 |
| 527,680 | 10/1894 | Gilchrist | 165/179 |
| 1,315,853 | 9/1919 | Nordling | 165/177 |
| 1,713,020 | 5/1929 | Bowne | 165/177 X |
| 2,252,045 | 8/1941 | Spanner | 165/177 X |
| 2,463,997 | 3/1949 | Rodgers | 165/179 X |
| 2,864,588 | 12/1958 | Booth et al. | 138/38 |
| 3,528,494 | 9/1970 | Levedahl | 165/179 |
| 3,779,312 | 12/1973 | Withers | 165/177 |

*Primary Examiner*—Albert W. Davis
*Assistant Examiner*—Theophil W. Streule, Jr.
*Attorney, Agent, or Firm*—Karl F. Ross

[57] ABSTRACT

A heat exchanger for the cooling of a gas, especially a gas containing $SO_2$, comprises a tube bundle whose tubes, composed of lead, bridge a pair of tube sheets and can be provided with internal longitudinal ribs. According to the disclosure, the extruded cylindrical tubes are reshaped by indentations in a direction transverse to the longitudinal axis. The indentations may be annular or staggered.

2 Claims, 7 Drawing Figures

Fig.1
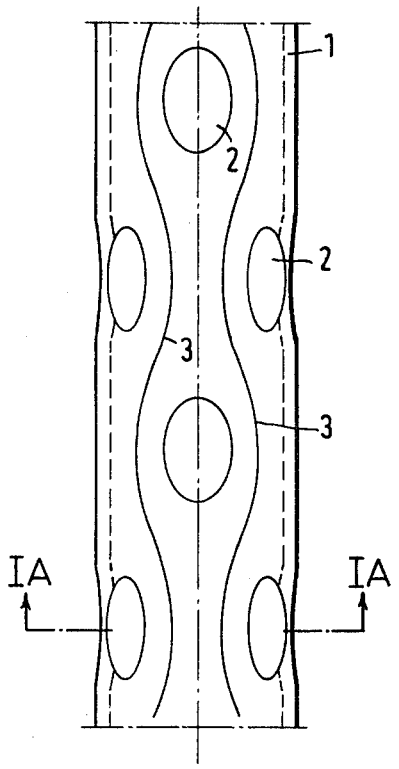
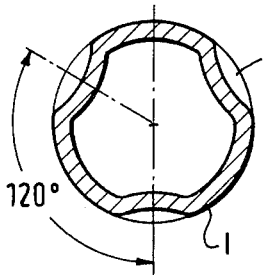
Fig. 1A

GAS COOLER WITH MULTIPLY DEFORMED LEAD TUBES

FIELD OF THE INVENTION

Our present invention relates to a tube-type heat exchanger, especially for the cooling of gases and, more particularly, to improvements in the tube structures of a cooler for gases containing sulfur dioxide ($SO_2$).

BACKGROUND OF THE INVENTION

It is known to provide a tube-type heat exchanger or cooler for the cooling of gases, such as gases which contain $SO_2$, the cooler or heat exchanger comprising an array of mutually parallel spaced-apart lead tubes which are externally cooled and span a pair of spaced-apart tube sheets.

In the heat-exchanger or cooler housing, a cooling fluid, e.g. water under pressure, can be introduced into the space around and between the tubes while the tubes themselves communicate with an inlet and an outlet for the gas stream, the inlet and outlet sides having diffuser configurations to distribute and collect the gas.

Various limiting conditions must be taken into consideration in the design of such gas coolers. For example, it is desirable to provide large units so that the system will have low gas-pressure drop and flow resistance and a maximum throughput and cooling efficiency.

However, this desire is opposed by the fact that the tubes are composed of lead and hence the cooler consists, in large measure, of lead so that the cooler is extremely heavy, especially if it is large.

Thus the size of the cooler has been limited by the ability to economically manufacture, transport and install same with the aid of conventional hoisting and transport equipment so that special apparatus for handling the unit is not required.

Therefore it is desirable, for a given size of gas cooler, to reduce the amount of lead contained therein. This is accomplished by using lead tubes having the smallest possible wall thickness. Especially thin lead tubes are thus preferred in practice.

This, however, gives rise to another problem. The operating conditions (e.g. pressure) and low strength of the lead impose a lower limit on the wall thickness for a given service life. Consequently, attempts have been made to improve upon the strength of the lead-containing material itself by alloying techniques. Even this cannot be carried out to the extent necessary to maximize the strength of thin-walled lead tubes because corrosion resistance is reduced with many alloying systems.

As a consequence, the prior-art systems using lead-tube heat exchangers or coolers have always been a compromise in consideration of all of the factors enumerated above. It is conventional in the art, therefore, to provide an extruded lead tube of a cylindrical outer configuration with an outer diameter of 70 mm and a wall thickness of about 6 mm, the tube wall having internal longitudinally extending fins or ribs. These fins may have a radial dimension of say 13 mm and can be provided in various heights, angular spacing and number. For example, six thin fins 13 mm high can be interleaved with six smaller intervening fins of a height of 7 mm in a particular tube construction.

Experiments have been made in attempts to reduce the quantity of lead per tube without materially reducing the flow cross section. For example, when an internally finned tube of the last-mentioned type but with an outer diameter of only 68 mm and a wall thickness of 5 mm was tested, with a saving of about 15% in material and weight, it proved unsatisfactory when exposed to normal operating conditions for prolonged periods.

Within about three hours of operation, each tube assumed gradually an oval shape and subsequently completely collapsed until the fins contacted each other.

Measurements have confirmed that the deformation of the tubes under operating conditions always begins at portions of the tube wall at which thickness is at the lowest tolerance limit.

Experience has indicated that conventional extrusion techniques cannot avoid eccentricities in the die core so that deviations of the wall thickness amounting to ±5% along the length of the tube and from tube to tube are not unusual.

The total or partial collapse of even some of the tubes of a gas cooler or hear exchanger renders the latter ineffective because the distribution of the gas and the cooling effect no longer are uniform and predictable in view of the reduced cross section of certain tubes.

Obviously, therefore, it is not a solution to simply attempt to reduce the wall thickness and outer diameter to decrease the weight.

Mention should be made of the fact that the collapse occurs, in conventional tubes, notwithstanding the expected reinforcing effect of the longitudinally extending fins or ribs which would suggest to the field that there is no solution to be found in modifying the configurations of the tubes for stiffening purposes.

OBJECTS OF THE INVENTION

It is the principal object of the present invention to provide an improved gas cooler utilizing lead-tubes, especially for gases containing sulfur dioxide, wherein the disadvantages of earlier coolers and heat exchangers are avoided.

Another object of this invention is to provide an improved cooler for the purposes described whose weight is substantially reduced without adverse effect upon the service life of the cooler.

Still another object of the invention is to provide an improved tube structure for use in such a gas cooler or heat exchanger.

SUMMARY OF THE INVENTION

These objects and others which will become apparent hereinafter are attained, in accordance with the present invention, in a gas cooler for sulfur dioxide gases which has, in the usual manner, a tube bundle of mutually parallel spaced-apart tubes of lead spanning a pair of tube sheets or plates and enclosed in a housing which will permit the passage of gas through the tubes and the passage of a cooling liquid between and around them. The lead tubes are extruded internally finned tubes in accordance with the present invention, but are partially reshaped at right angles to their longitudinal axes. i.e. are deformed by forces applied transversely to the longitudinal axis at longitudinally spaced locations along the tube from the original uniform-cross-section extruded lead tubular profile.

The reshaping of the tubes may result in indentations which are staggered along and around the tube or in axially spaced-apart circumferential recesses in the outer surface of the tube. The deformation can be effected by applying these forces inwardly from the exterior or by retaining the tube in a die or mold and applying an internal fluid pressure sufficient to expand the tube outward to conform to this die or mold.

Extruded tubes which have a given wall thickness and have been reshaped in accordance with the invention have been found, quite surprisingly, to be able to withstand a greater pressure; the reshaping according to the invention permits a saving of 15% or more in material and weight by allowing tubes of the smaller wall thickness to be used in spite of the fact that such smaller wall thicknesses have been found to be ineffective with tubes which are uniform in cross section throughout their length.

BRIEF DESCRIPTION OF THE DRAWING

The above and other features of the present invention will become more readily apparent from the following description, reference being made to the accompanying drawing in which:

FIG. 1 is an elevational view of a lead tube for use in a heat exchanger or cooler in accordance with the present invention;

FIG. 1A is a section taken along the line IA—IA of FIG. 1;

SPECIFIC DESCRIPTION

Figure 4:
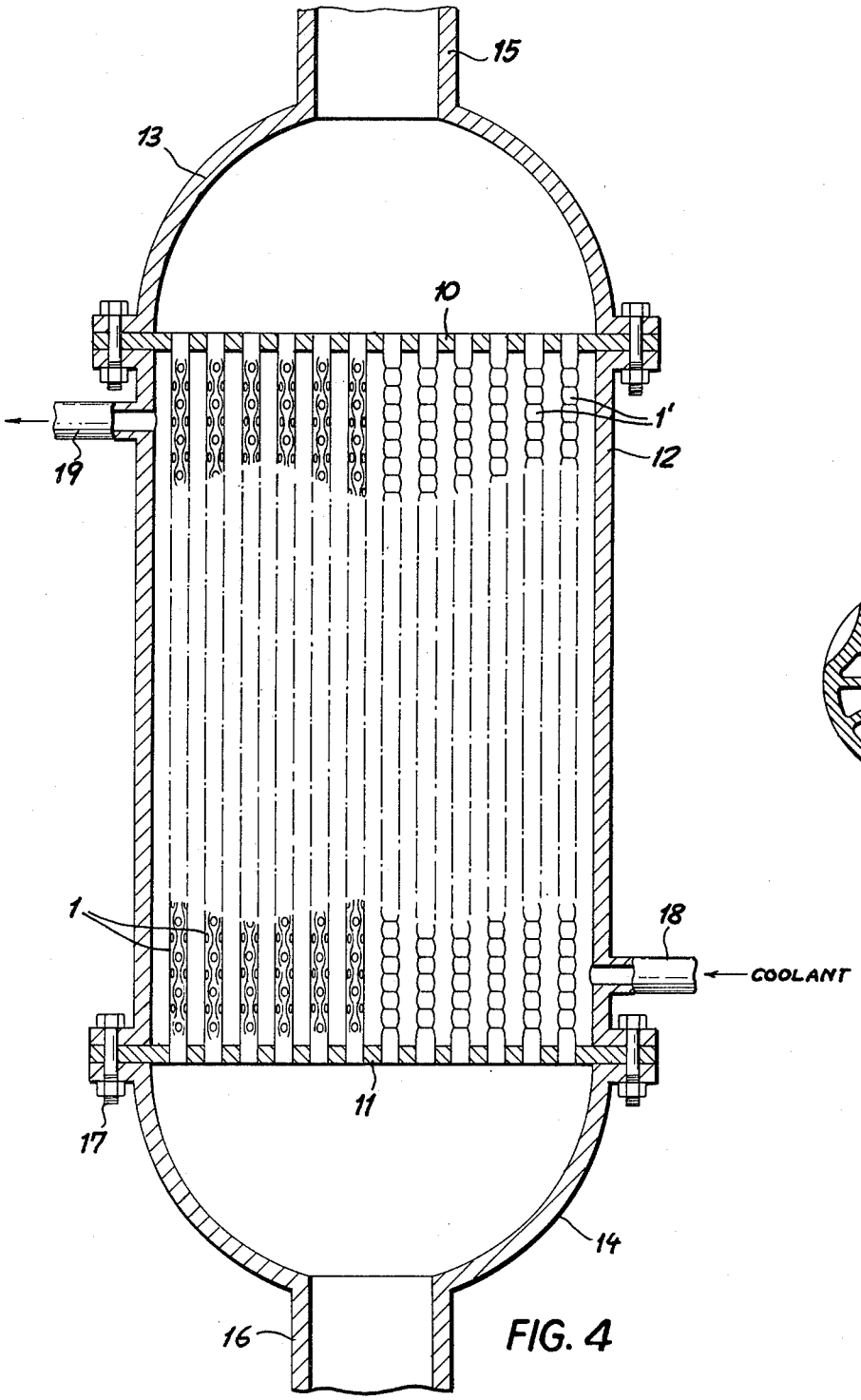
FIG. 4 is a cross-sectional view through a gas cooler in accordance with the invention.

In FIGS. 1 and 1A, we have shown a lead tube 1 in elevation and cross section, respectively, for use in a heat exchanger or gas cooler of the type shown diagrammatically in FIG. 4. The heat exchanger of FIG. 4 comprises a pair of tube sheets 10, 11 which are spanned by mutually parallel spaced-apart lead tubes 1 and 1' of substantially constant wall thickness deformed as will be described in greater detail below from their original uniform extruded profiles. The deformations of the tubes 1 correspond to those discussed in connection with both FIGS. 1 and 1A while the deformation of the tubes 1' correspond to those described in connection with FIGS. 2 and 2A. The tube sheets are received in a housing 12 defining spaces between and among tubes 1, 1' with which a cooling-liquid inlet conduit 18 and a cooling-liquid outlet conduit 19 communicate. The coolant is generally under pressure, this pressure being applied inwardly on the lead tubes.

An inlet bell or diffuser 14 is connected with a conduit 16 supplying the gas to be cooled which passes through the tubes 1 and 1' to an outlet bell or diffuser 13 having a conduit 15 for leading away the cooled sulfur dioxide gas. Bolts 17 connect the flanges of the housing 12 with the flanges of the bells 13 and 14 and can be removed to allow access to the lead tubes.

Figure 3:
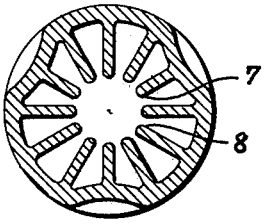
FIG. 3 is a cross-sectional view of a tube embodying the invention and composed of lead, corresponding generally to the section of FIG. 1A but illustrating the presence of internal fins which have been omitted in FIGS. 1A and 2A solely to simplify the illustration of the formations imparted to the tubes.

Although in FIG. 1A we have not shown any internal fins, it will be understood that all the lead pipes are internally finned, e.g. as represented by the fins 7 and 8 of the tube of FIG. 3.

As the gas is passed upward through the tubes, it is cooled by indirect heat exchange with the cooling liquid traversing the intertube spaces.

According to the invention, the tubes 1 are especially thin-walled, e.g. with a wall thickness of less than 6 mm and preferably less than about 5 mm.

The tube 1 (FIGS. 1 and 1A) is reshaped around and along its periphery by means of steel balls which are pressed inward at each level at locations peripherally spaced 120° apart. The resulting sets of indentations 2, which are angularly offset from one another on adjacent levels have the configuration of spherical segments.

The lines 3 shown in FIG. 1, surrounding the points at which the outer wall has been pressed inward, represent the outlines or boundaries of the reshaped portions. From FIGS. 1A and 3, however, it will be seen that the wall thickness of the tubes is not significantly altered by the indentations 2.

Figures 2, 2A:
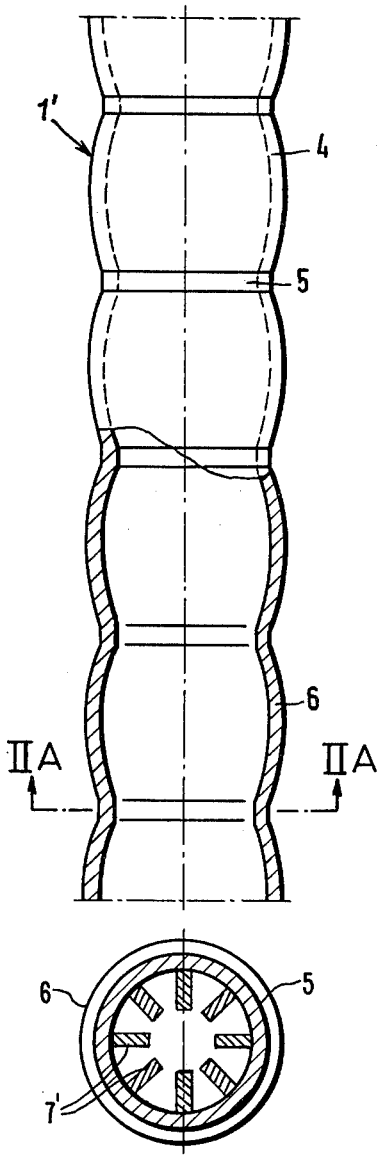
FIG. 2 is an elevational view, partly broken away, of another lead tube for use in a cooler embodying the present invention.
FIG. 2A is a cross-sectional view taken along the line IIA—IIA of FIG. 2.

FIGS. 2 and 2A are respectively an elevational view and a cross sectional view of the lead tubes 1' which have also been used in the heat exchanger of FIG. 4. The wall 4 of the lead tube is pressed inward, and is deformed by internal fluid pressure acting outwardly, to have annular recesses 5 which correspond to slight annular constrictions, defining between them a succession of barrel-shaped outwardly convex portions 6.

The internal unitary fins of the tubes 1' have not been illustrated in FIG. 2 but have been shown at 7'—FIG. 2A.

Figure 5:
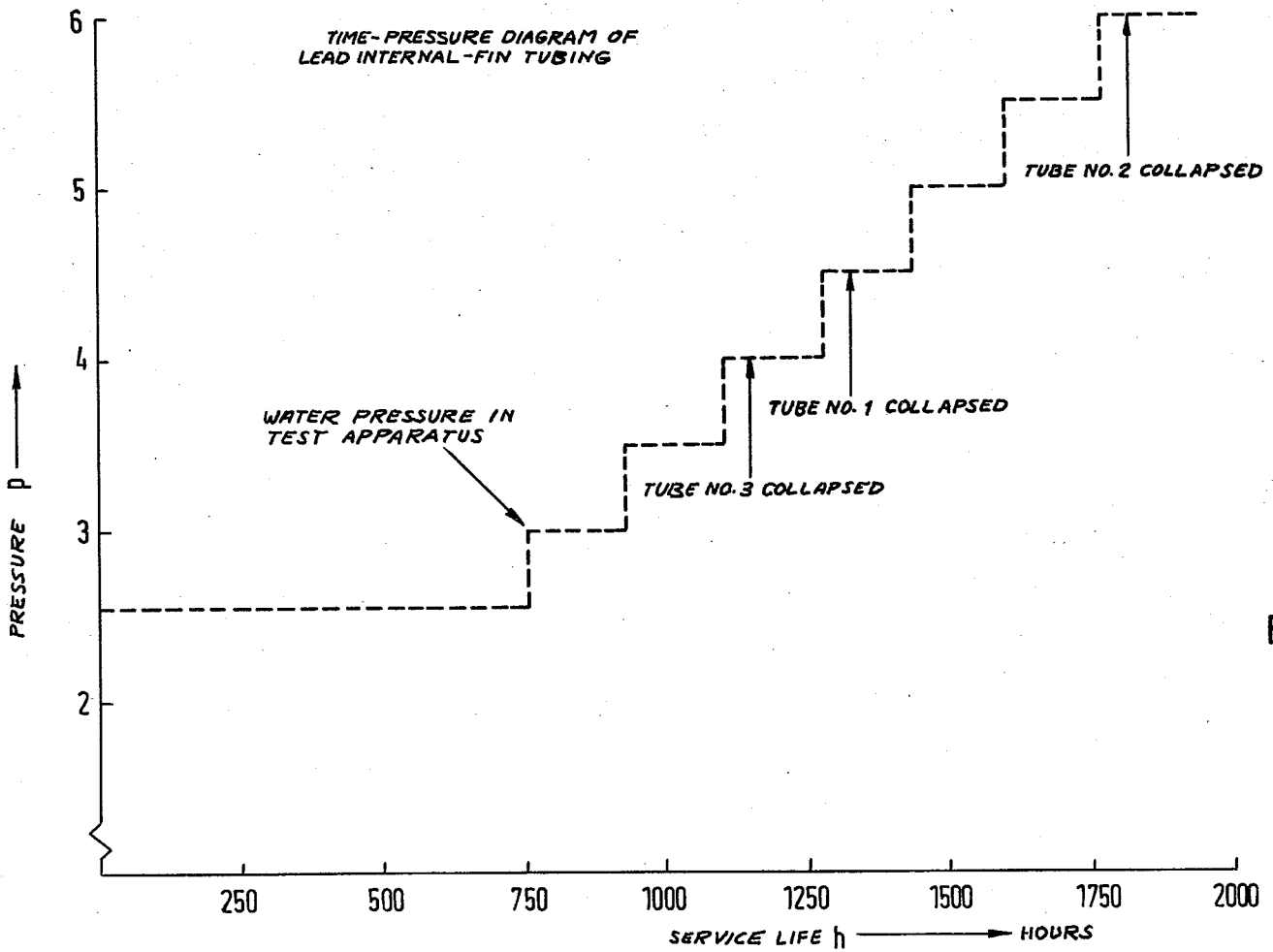
FIG. 5 is a graph showing the results of creep tests for the tubes.

FIG. 5 is a chart representing the results of creep tests. In these tests, external water pressure (plotted along the ordinate) is applied to sections of the lead tube in a testing apparatus. The service life is plotted along the abscissa in hours, the pressure being given in bars.

An external pressure of 2.5 bars was initially applied to the specimen for 750 hours. The pressure was then increased in steps of 0.5 bar at approximately equal intervals of time. The non-reshaped control tube (No. 3) collapsed at a pressure of 4 bars after 150 hours so that its internal fins were in contact with one another. The tube specimen with spheroidal indentations (FIGS. 1 and 1A) represented at No. 1 collapsed after 1330 hours at a pressure of 4.5 bars. With the waist configuration of FIGS. 2 and 2A (tube No. 2), which had spaced apart annular constrictions and barrel shape portions between them, the service life was 1820 hours and the collapsing pressure was 6 bars. This shows that the configuration of FIGS. 2 and 2A will give approximately twice the service life of the tube of FIGS. 1 and 1A and about 8 to 10 times the service life of a tube which has not been reshaped. The reshaped tube can also be used under much higher pressure for a given service life.

We claim:

1. An apparatus for cooling a gas containing sulphur dioxide, comprising:

a heat-exchanger housing adapted to receive a liquid coolant under a pressure greater than that of said gas and provided with a pair of parallel spaced-apart tube sheets;

a bundle of mutually parallel but transversely separated extruded lead tubes of substantially constant wall thickness perpendicularly spanning said tube sheets and defining between them a space for said coolant, each of said tubes being internally formed with a plurality of radially inwardly extending longitudinally fins and being deformed inwardly at axially spaced-apart locations, with formation of sets of peripherally spaced-apart indentations of spherically segmental curvature, to prevent collapse of the tubes under a pressure gradient developed thereacross between said coolant and said gas, adjacent sets of indentations being relatively angularly offset;

first conduit means connected to said housing for passing said coolant through said space; and second conduit means communicating with said tubes for passing said gas therethrough.

2. An apparatus for cooling a gas containing sulphur dioxide, comprising:

a heat-exchanger housing adapted to receive a liquid coolant under a pressure greater than that of said gas and provided with a pair of parallel spaced-apart tube sheets;

a bundle of mutually parallel but transversely separated extruded lead tubes of substantially constant wall thickness perpendicularly spanning said tube sheets and defining between them a space for said coolant, each of said tubes being internally formed with a plurality of radially inwardly extending fins and being deformed inwardly at axially spaced-apart locations, with formation of annular constrictions separated by outwardly convex barrel-shaped portions, to prevent collapse of the tubes under a pressure gradient developed thereacross between said coolant and said gas;

first conduit means connected to said housing for passing said coolant through said space; and second conduit means communicating with said tubes for passing said gas therethrough.

* * * * *